US009598149B1

(12) United States Patent
Conn et al.

(10) Patent No.: US 9,598,149 B1
(45) Date of Patent: Mar. 21, 2017

(54) SYSTEM FOR THE DEPLOYMENT AND RECOVERY OF TOWED SENSORS

(71) Applicants: Michael W. Conn, Panama City, FL (US); Ricardo C. Echeverria, Panama City, FL (US)

(72) Inventors: Michael W. Conn, Panama City, FL (US); Ricardo C. Echeverria, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/205,509

(22) Filed: Jul. 8, 2016

(51) Int. Cl.

| | |
|---|---|
| ***B63B 35/40*** | (2006.01) |
| ***B63B 21/66*** | (2006.01) |
| ***B63B 21/56*** | (2006.01) |
| ***B63B 27/00*** | (2006.01) |

(52) U.S. Cl.
CPC ..... *B63B 21/66* (2013.01); *B63B 21/56* (2013.01); *B63B 27/00* (2013.01)

(58) Field of Classification Search
CPC ..... B63B 21/56; B63B 21/66; B63B 27/00; B63B 35/40
See application file for complete search history.

(56) References Cited

U.S. PATENT DOCUMENTS

| | | | | |
|---|---|---|---|---|
| 7,712,429 | B1 * | 5/2010 | Gibson | B60P 3/1058 114/259 |
| 2008/0202405 | A1 * | 8/2008 | Kern | B63B 23/30 114/259 |
| 2012/0192780 | A1 * | 8/2012 | Soreau | B63B 23/32 114/259 |
| 2013/0291779 | A1 * | 11/2013 | Clarke | B63B 23/32 114/259 |

* cited by examiner

*Primary Examiner* — Stephen Avila
(74) *Attorney, Agent, or Firm* — James T. Shepherd

(57) ABSTRACT

A Towed Body Recovery Drone facilitates the safe recovery of fragile towed sensors by surface craft. The TBRD comprises a buoyant sponson section sized to give the TBRD minimal buoyancy necessary to keep the sensor on the surface in a static condition. Structural elements and skids are arranged to protect the sensor from impact with rigid objects and allow the TBRD to be pulled aboard a surface craft by means of a ramp structure. A capture device manages the sensor's tow cable and restrains the sensor within the TBRD structure.

12 Claims, 2 Drawing Sheets

SYSTEM FOR THE DEPLOYMENT AND RECOVERY OF TOWED SENSORS

STATEMENT OF GOVERNMENT INTEREST

The invention described herein may be manufactured and used by or for the Government of the United States of America for governmental purposes without the payment of any royalties.

BACKGROUND OF THE INVENTION (1) Field of the Invention

The present invention relates generally to a method of safe recovery of fragile towed sensors by surface craft.

(2) Description of the Prior Art

Traditional methods for recovery of fragile towed sensors to surface craft utilize shipboard cranes or large A-frame structures to lift the sensor clear of the water a safe distance from the surface craft. Once the sensor is clear of the water it can be oriented by mechanical means and secured or brought over the ship's deck and guided to an appropriate storage apparatus by riggers.

Significant effort is required on the part of operators or riggers to ensure that the towed body is recovered in a safe orientation due to motion induced in the towed body and the surface craft by the seas. The greatest danger to the towed body is posed by relative motion between the towed body and the surface craft, or any of its lifting gear, which could lead to impact between the towed body and the surface craft, or any of its lifting gear. Damage can be caused due to the impact between an unprotected, fragile feature on the towed body and a rigid structure.

Many methods to recover towed sensors have been fielded, for example boom cranes or A-frames. Some systems cannot be utilized in smaller surface craft. Even when available, these methods suffer from deficiencies, including, but not limited to, less than adequate functionality, decreased stabilization of the sensor during recovery, increased weight and size of recovery equipment and portability issues. Many are cumbersome to set up and are not suitable for deployment in the best angle suitable to the proper orientation or stabilization for safe recovery of the sensor. Additionally, current methods may increase the risk of serious impact between rigid structures and the sensor due to instability of the sensor during recovery and lack of lifting capacity. This can lead to costly damage or require significant oversight from the ship's crew.

The prior art does not show the features of the present invention, which provides for a more easily transported, rugged, lightweight, and stable method of recovery which overcomes the limitations mentioned above. Accordingly, those of skill in the art will appreciate the present invention which addresses those problems.

SUMMARY OF THE INVENTION

Accordingly, it is an object of the present invention to provide a Towed Body Recovery Drone (TBRD) to facilitate the safe recovery of fragile towed sensors by surface craft incapable of employing traditional methods due to limited vessel weight capacity, limited lift capacity, or crew limitations.

Another object of the present invention is to provide a buoyant sponson section sized to give the TBRD minimal buoyancy necessary to keep the sensor on the surface in a static condition. A sponson as used herein is a buoyant section on a watercraft to increase stability and buoyancy.

Another object of the invention is to provide structural elements and skids arranged to protect the sensor from impact with rigid objects and allow the TBRD to be pulled aboard a rigid hulled inflatable boat (RHIB) or other surface craft by means of a ramp structure.

A further object of the invention is to provide a capture device responsible for managing the sensor's tow cable and restraining the sensor within the TBRD structure.

Another object of the invention is to provide drag features sized to generate a drag force greater than the excess buoyancy of the buoyant sponson section in order to facilitate subsurface capture of the sensor.

Still another object of the invention is to provide ramp structures for deployment and recovery of the TBRD from the RHIB.

Accordingly, one embodiment comprises a system for deployment and recovery of a towed body from and to a watercraft using a towed body recovery drone (TBRD). The TBRD includes a framework that defines a towed body receiving region therein that is surrounded by the framework. The framework includes an upper ribbed section and side ribbed sections. The TBRD has openings at the rear and bottom that lead to the towed body receiving region within the framework. The framework is sized larger than the towed body to extend around the towed body when the towed body is within the towed body receiving region. The TBRD includes at least one buoyant sponson section. The TBRD further includes a plurality of skids mounted to a lowermost position on the side ribbed sections that extend below the towed body. The TBRD includes a capture device including a cable guide mounted adjacent the upper ribbed section. The TBRD has drag members mounted to a rear of the framework. The drag members are oriented to produce a drag force on the TBRD as the TBRD is pulled toward the watercraft.

Implementations of the system may include at least one buoyant sponson section being secured to the upper ribbed section. The sponson section has buoyancy that supports the TBRD in water while the side ribbed portions extend into the water during operation so that the towed body receiving region is maintained underwater when the TBRD is floating in water. The drag members are oriented and sized to generate drag force with a downward component, where the downward component of the drag force is greater than the buoyancy when towed above a predetermined tow speed.

The system further includes at least one buoyant sponson section being sized to give the TBRD a minimal buoyancy necessary to keep the sponson section on the surface of the water in a static condition whereupon the towed body receiving region is maintained underwater.

The system further includes a pivotal ramp structure mounted on the watercraft including a plurality of pivots and rods that pivot to a retrieval or deployment angle with respect to the watercraft's deck. The ramp structure can then pivot to position the TBRD substantially parallel to the watercraft.

The system further includes angled skid guides mounted to the front of the TBRD that are angled at the deployment angle when the TBRD is floating in water within about twenty degrees. The system has a framework that is open between the ribs forming the framework where most of the buoyancy of the TBRD is provided by a buoyant sponson section.

The system includes at least one buoyant sponson section which may comprise two sponson sections mounted to the side ribbed portions and extending along from front to rear substantially along the length of the TBRD and where the system is operable for recovery of the towed body without use of a crane.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Figure 1:
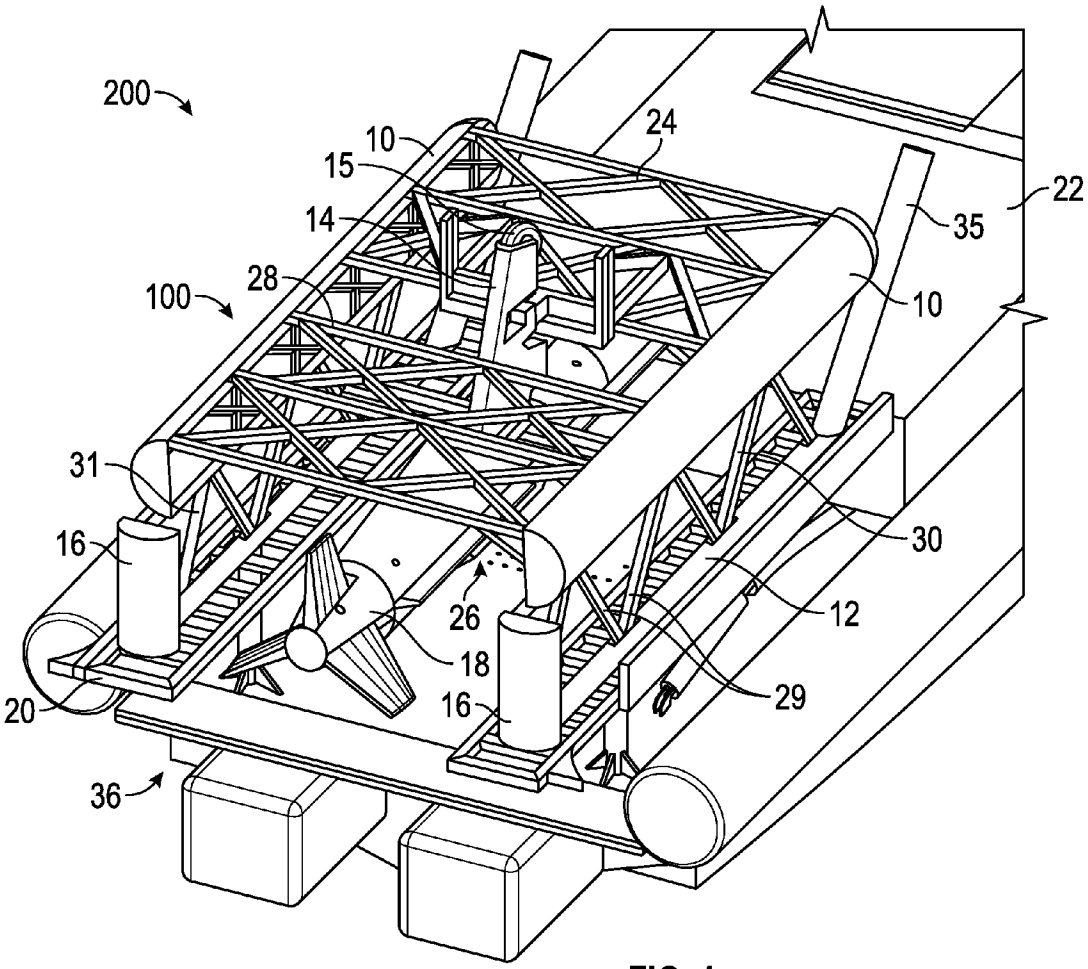
FIG. 1 is a perspective view showing a TBRD with sensor aboard a RHIB prior to deployment or after recovery in accord with one possible embodiment of the invention.
Figure 2:
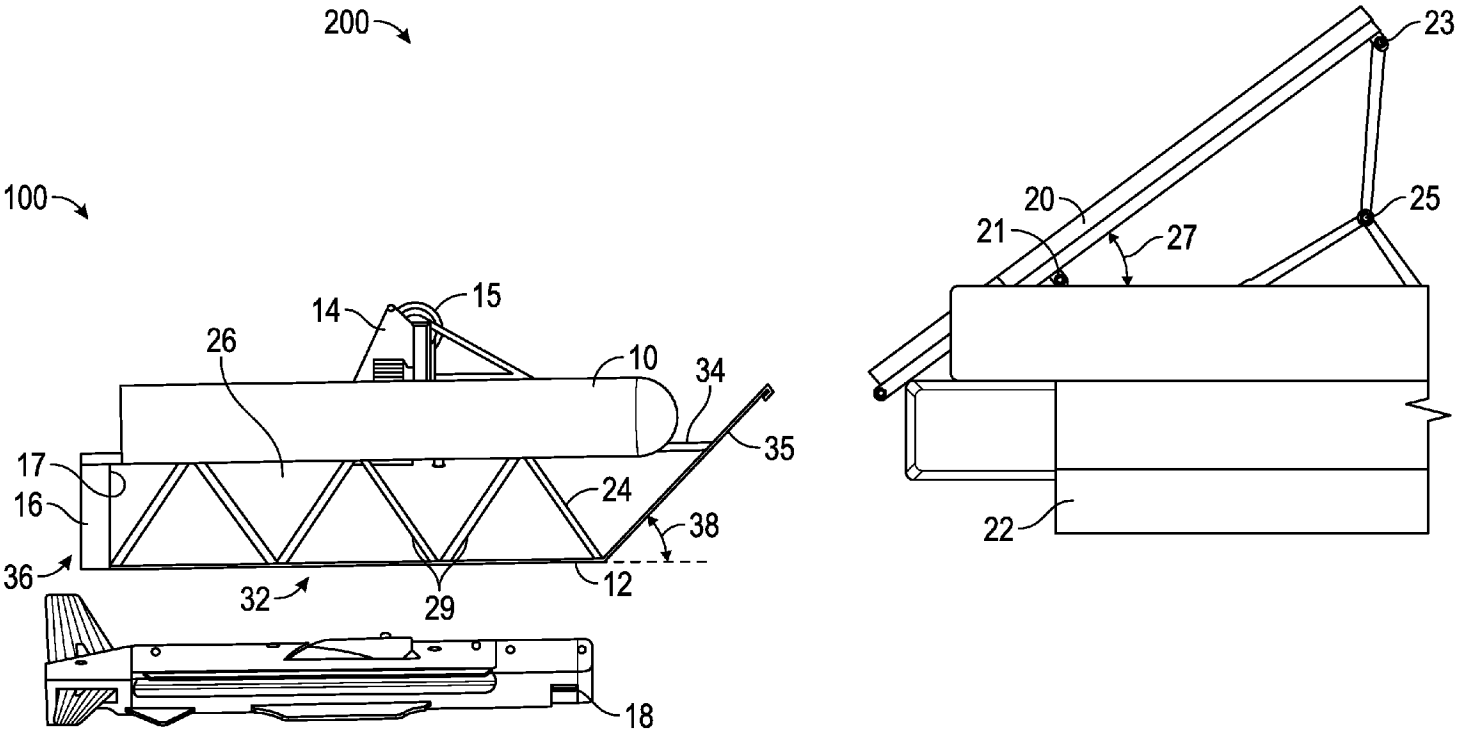
FIG. 2 is a side view showing a fully deployed TBRD and a sensor behind a surface craft during deployment or recovery in accord with one possible embodiment of the invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. The terms front, rear, sides, bottom and the like refer to the operating positions which is the case when the TBRD 100 is in the water behind a watercraft whereupon the front of the TBRD 100 is closest to the watercraft as shown in FIG. 1 and FIG. 2. So that during operation the front of the Towed Body Recovery Drone (TBRD) 100 is generally facing the rear of a surface craft such as Rigid Hulled Inflatable Boat (RHIB) 22.

Recovery system 200 comprises TBRD 100, ramps 20, and a watercraft such as but not limited to RHIB 22. It will be appreciated that the RHIB 22 is a relatively small watercraft. There is no requirement for cranes, which would necessitate the use of larger watercraft and where the use of cranes result in many recovery problems including increased risk of damage to the recovery of the towed body. In other words, a small watercraft can be utilized to more safely, more reliably, and more conveniently recover the drone than larger watercraft utilizing a crane.

Turning now to the drawings, and more particularly FIG. 1, there is shown a perspective view of one possible embodiment of the TBRD 100 aboard a RHIB 22. The TBRD 100 is comprised of parallel buoyant sponson sections 10 positioned above structural elements. In this case, two buoyant sponson sections 10 are utilized at the top sides of TBRD 100.

The sponson sections 10 are mounted to a rigid framework 24, which may have many configurations but generally describe a protected towed body receptacle region 26 within TBRD 100. Rigid framework 24 may comprise rods or tubular elements, or solid posts or struts, of any combination of these that interconnect to form a truss structure. The components of the truss structure of rigid framework 24 comprise and upper ribbed section 28, side ribbed sections 30 and 31, and a front ribbed section 34, all of which surround and protect sensor 18 within a receptacle region 26 inside framework 24.

Rigid framework 24 is open at the bottom with lower entrance 32 (See FIG. 2) and rear entrance 36 that allows sensor 18 to be received into receptacle region 26 utilizing the tow cable (not shown) to guide sensor 18 into receptacle region 26 from the bottom. Once secured within receptacle region 26, sensor 18 is protected on the sides and top from damage. Receptacle region 26 may also be padded to further protect sensor 18.

Skids 12 on the bottom of TBRD 100 extend below receptacle region 26 to protect the sensor from the bottom so long as TBRD is landed on a relatively flat surface or on ramps 20 as discussed herein.

Accordingly TBRD 100 is configured to protect a sensor 18 from impact with rigid objects and allow the TBRD 100 to be pulled aboard the RHIB 22 by means of a ramp structure 20.

A capture device 14 manages the sensor's tow cable (not shown) and restrains the sensor 18 within the TBRD's 100 structure utilizing the cable to pull sensor 18 into receptacle region 26. Capture device 14 may comprise cable guide 15 which in this embodiment may comprise a pulley but could also be comprised of other types of cable guides. Cable guide 15 is used to guide the tow cable which, in turns, pulls sensor 18 through lower entrance 32 and/or rear entrance 36 into receptacle region 26. Capture device 14 may further comprise a clamp or clamping mechanism (not shown) through which the tow cable passes. The clamp can grab and hold the tow cable so that the RHIB can tow the TBRD 100 and sensor 18 together.

Drag members 16 are positioned and sized to generate a drag force with a downward force component greater than the excess buoyancy force of the sponson section 10 in order to facilitate subsurface capture of the sensor. This will occur at a tow speed that is greater than a predetermined tow speed that is preferably maintained if conditions permit. Drag members 16 may comprise surfaces 17 that engage the water and preferably provide some downward force.

In the present embodiment, a plurality of substantially parallel ramps 20 may be mounted on the back of the RHIB 22 configured at a distance apart to correlate to the TBRD structural elements including skid guides 35 and skids 12 of the TBRD 100. The ramps 20 may pivot at pivots 21, 23, 25 and the like as indicated by deployment/retrieval angle 27 to be moveable from a retrieve position as indicated in FIG. 2 to a secured position as indicated in FIG. 1 by folding the ramps to lay substantially flat on, or parallel to, the deck surface of the RHIB 22. Skid guides 35 are mounted on the front of TBRD 100 and may be angled as indicated by angle 38 to be approximately the same angle as angle 27 plus or minus about twenty degrees.

In this way, TBRD 100 can be readily pulled in. Once TBRD 100 is pulled in, the ramps 20 can be lowered and TBRD 100 is then secured to RHIB 22 for safe transport prior to deployment or after recovery of the sensor 18. The sensor 18 is secured to the TBRD 100 within the TBRD structure by cables from the capture device 14. The capture device 14 restrains the sensor 18 to the TBRD 100 structure.

Turning to FIG. 2, the relative positions of the support craft (RHIB) 22, TBRD 100, and sensor 18 are shown either immediately after release of the sensor or immediately prior to capture of the sensor 18. During a deploy or retrieve evolution, TBRD 100 would be deployed via ramps 20 pivoted upwardly behind the RHIB 22 and towed by dedicated line(s) (not shown).

In the deployment case, TBRD 100 is contained within the protected receptacle region 26 prior to being deployed to a desired distance behind the RHIB 22, the capture device 14 disengages from the sensor 18 so that the sensor can move downward and rearward through lower entrance 32 and rear entrance 36, and the sensor's 18 tow cables extend allowing the sensor 18 to perform a standard mission. Cable guide 15, which may be a pulley, may be utilized to guide the cable for this purpose. When the sensor 18 is clear of the TBRD 100, TBRD can be recovered to the RHIB 22 by the dedicated TBRD tow lines. The TBRD may be hauled aboard the RHIB via ramps 20. The ramps 20 may be raised or pivoted such that one end is lowered into the water allowing the TBRD 100 to be hauled aboard the RHIB 22.

In the retrieval case, TBRD 100 is deployed to a desired distance behind the RHIB 22 and the sensor tow cable is hauled in to retrieve the sensor 18. While the sensor is being hauled in, the drag members 16 on the TBRD 100 mounted on the rear of framework 24 maintain a reliable standoff and orientation between the RHIB 22 and the TBRD 100 with sensor 18 secured to TBRD 100. The drag members are mounted on the trailing end of the TBRD structure perpendicular or generally perpendicular to the water surface which orientation provides drag and a downward force. If the sensor tow tension is large enough, e.g., by increasing the speed of the tow vehicle 22, TBRD 100 will submerge due to drag on the TBRD 100 and sensor tow tension until TBRD 100 captures sensor 18, at which point the sensor 18 is allowed to surface under the buoyancy of TBRD 100. The TBRD 100 and sensor 18 are then hauled aboard the RHIB 22 via ramps 20.

If the sensor tow tension in not sufficient to overcome TBRD's excess buoyancy, the sensor 18 is slowly brought to the surface and captured by TBRD 100 in a near surface position. Although near surface capture is not ideal, the limited buoyancy of TBRD 100 will minimize the impact of wave action on the capture process and TBRD's 100 relatively low mass will allow the motion of TBRD 100 and the sensor 18 to be coupled by the sensor tow cable and similar forces acting on both bodies, minimizing impact to the sensor 18. Once the sensor 18 is captured by TBRD 100, TBRD 100 and the sensor 18 are dragged aboard the RHIB 22 by the dedicated TBRD tow lines and ramps 20. The sensor is protected from impact within receptacle region 26 during the process by the structural ribbed sections of TBRD 100. In one embodiment, risk of damage to the sensor 18 during recovery may be significantly mitigated by the addition of impact absorbing padding (not shown) to the TBRD structure, specifically to the framework adjacent to receptacle region 26.

The risk to sensor 18 being recovered is significantly reduced through the use of TBRD 100. Because of the relatively low mass of TBRD 100, any impact between TBRD and the sensor has relatively low energy as compared to contact with a rigid watercraft. Furthermore the effects of such an impact are easily mitigated by padding the TBRD structure. Once the sensor has been captured by TBRD 100, it is protected from impact during the recovery to the surface craft reducing or eliminating the need for personnel to directly intervene between the sensor and any rigid structures during the recovery process. Additionally, the ramp features needed to bring TBRD and the captured sensor aboard the surface craft are lighter and less bulky than A-frames or boom cranes used in the prior art to bring sensors aboard a surface craft. This combination of characteristics allows the TBRD to be used to deploy and recover sensitive sensors from surface craft that would be incapable of deploying the same sensor by traditional methods due either to limited (crane) lift capacity or crew limitations.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive or to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A system for deployment and recovery into water of a towed body from a watercraft comprising:

a framework that defines a towed body receiving region therein that is surrounded by said framework, said framework comprising an upper ribbed section and first and second side ribbed sections, said framework defining openings at a rear and bottom that lead to said towed body receiving region within said framework, said framework being sized so that said receiving region extends around the towed body when the towed body is within said towed body receiving region;

at least one buoyant sponson section coupled to said framework adjacent to said upper ribbed section;

at least one skid mounted to a lowermost position on each of said side ribbed sections;

a capture device comprising a cable guide mounted on said framework adjacent to said upper ribbed section; and at least one drag member mounted to a rear of said framework, said at least one drag member being oriented to produce a downward-oriented drag force on said framework as said framework is pulled toward the watercraft.

2. The system of claim 1, further comprising skid guides coupled to the front of said framework and disposed at an upward angle relative to said skids.

3. The system of claim 2, wherein said sponsons together provide sufficient buoyancy to support the combined weight of said framework, said skids, said skid guides, and said capture device.

4. The system of claim 3, wherein said downward-oriented drag force exceeds the excess buoyancy of said sponsons at a predetermined speed such that said framework submerges under water at said predetermined speed.

5. The system of claim 1, further comprising a pivotal ramp structure mounted on the watercraft, said ramp structure comprising a plurality of pivots and rods that pivot said ramp structure to a deployment/retrieval angle relative to the deck of the watercraft and to a secured position substantially parallel to the deck of the watercraft.

6. The system of claim 4, further comprising a pivotal ramp structure mounted on the watercraft, said ramp structure comprising a plurality of pivots and rods that pivot said ramp structure to a deployment/retrieval angle relative to the deck of the watercraft and to a secured position substantially parallel to the deck of the watercraft.

7. The system of claim 6, wherein said deployment/retrieval angle is substantially equal to said upward angle of said skid guides.

8. The system of claim 6, further comprising a tow cable coupled at one end to said ramp structure and passing through said cable guide.

9. The system of claim 8, wherein said capture device further comprises a clamp and wherein said tow cable passes through said clamp, said clamp being operable to grab and hold said tow cable.

10. The system of claim 2, further comprising padding disposed on said framework adjacent to said towed body receiving region.

11. The system of claim 5, further comprising padding disposed on said framework adjacent to said towed body receiving region.

12. The system of claim 6, further comprising padding disposed on said framework adjacent to said towed body receiving region.

* * * * *